US011193255B2

(12) United States Patent
Holl et al.

(10) Patent No.: US 11,193,255 B2
(45) Date of Patent: Dec. 7, 2021

(54) SYSTEM AND METHOD FOR MAXIMIZING PRODUCTIVITY OF A WORK VEHICLE

(71) Applicant: Deere & Company, Moline, IL (US)

(72) Inventors: Kyle A. Holl, Durango, IA (US); Anthony K. Kraft, Epworth, IA (US)

(73) Assignee: Deere & Company, Moline, IL (US)

( * ) Notice: Subject to any disclaimer, the term of this patent is extended or adjusted under 35 U.S.C. 154(b) by 323 days.

(21) Appl. No.: 16/528,200

(22) Filed: Jul. 31, 2019

(65) Prior Publication Data

US 2021/0032850 A1 Feb. 4, 2021

(51) Int. Cl.

| | |
|---|---|
| ***E02F 9/22*** | (2006.01) |
| ***E02F 9/20*** | (2006.01) |
| ***E02F 3/84*** | (2006.01) |
| ***E02F 9/26*** | (2006.01) |

(52) U.S. Cl.

CPC ..... *E02F 9/2235* (2013.01); *E02F 3/847* (2013.01); *E02F 9/2029* (2013.01); *E02F 9/2253* (2013.01); *E02F 9/262* (2013.01); *E02F 9/265* (2013.01)

(58) Field of Classification Search

CPC ..... E02F 9/2235; E02F 9/2029; E02F 3/847; E02F 9/262; E02F 9/2253; E02F 9/265; E02F 9/205; E02F 3/76; E02F 3/80; E02F 3/84; E04H 6/42; G01D 21/02

See application file for complete search history.

(56) References Cited

U.S. PATENT DOCUMENTS 3,381,546 A * 5/1968 Holl ..... F16H 3/64 475/279
4,194,574 A 3/1980 Benson et al.
4,630,685 A 12/1986 Huck, Jr. et al.
5,815,826 A 9/1998 Henderson et al.

(Continued)

FOREIGN PATENT DOCUMENTS

CN 104863204 B 1/2018
DE 102005031135 A1 3/2006

(Continued)

OTHER PUBLICATIONS

"Measuring Motor Grader Productivity." Engineering & Mining Journal, Jun. 1993, vol. 194, Issue 6, p. 11 (2 pages).

(Continued)

*Primary Examiner* — Russell Frejd

(57) ABSTRACT

A system for maximizing productivity of a work vehicle is disclosed. The system includes a first sensor system that generates a first signal output indicative of a height of a material arranged forward of the work vehicle. A second sensor system generates a second signal output indicative of a position and height of a material transport blade coupled to the work vehicle. An actuator system configured to adjust the position and height of the material transport blade. An electronic data processor is communicatively coupled to each of the first sensor system, the second sensor system, and the actuator system. The electronic data processor determines a material flow rate based on the first and second signal outputs, and generates a command signal received by the actuator system to dynamically adjust a plurality of operating parameters associated with the material transport blade to maximize the material flow rate.

20 Claims, 5 Drawing Sheets

(56) References Cited

U.S. PATENT DOCUMENTS

| | | | | |
|---|---|---|---|---|
| 6,736,216 | B2 | 5/2004 | Savard et al. | |
| 7,891,182 | B2 | 2/2011 | Kelly et al. | |
| 7,917,265 | B2 | 3/2011 | Kale et al. | |
| 8,296,019 | B2 | 10/2012 | Kendrick | |
| 8,612,103 | B2 | 12/2013 | Nicholson et al. | |
| 9,297,146 | B1 | 3/2016 | Wei et al. | |
| 2013/0255977 | A1 | 10/2013 | Braunstein et al. | |
| 2014/0178164 | A1* | 6/2014 | Peterson | E02F 3/432 414/685 |
| 2014/0270380 | A1 | 9/2014 | Morin | |
| 2015/0225923 | A1 | 8/2015 | Wallace et al. | |
| 2015/0240453 | A1 | 8/2015 | Jaliwala et al. | |
| 2016/0076224 | A1 | 3/2016 | Edara et al. | |
| 2016/0299116 | A1 | 10/2016 | Talmaki et al. | |
| 2017/0226717 | A1 | 8/2017 | Cherney | |
| 2018/0061040 | A1 | 3/2018 | Beery et al. | |
| 2018/0174291 | A1 | 6/2018 | Asada et al. | |
| 2019/0024340 | A1 | 1/2019 | Ono | |
| 2019/0078292 | A1 | 3/2019 | Ono | |
| 2019/0093313 | A1 | 3/2019 | Ono | |
| 2020/0011029 | A1 | 1/2020 | Sano et al. | |

FOREIGN PATENT DOCUMENTS

| | | | |
|---|---|---|---|
| DE | 102017204315 | A1 | 9/2018 |
| WO | 2017163768 | A1 | 9/2017 |
| WO | 2017163823 | A1 | 9/2017 |
| WO | 2017164053 | A1 | 9/2017 |
| WO | 2018051742 | A1 | 3/2018 |

OTHER PUBLICATIONS

Unpublished U.S. Appl. No. 16/058,055; Peat, et al.; filed Aug. 8, 2018 (25 pages).

Unpublished U.S. Appl. No. 16/029,845; Sherlock, et al.; filed Jul. 9, 2018 (25 pages).

German Search Report issued in counterpart application No. 102020207978.1 dated Apr. 29, 2021 (08 pages).

* cited by examiner

SYSTEM AND METHOD FOR MAXIMIZING PRODUCTIVITY OF A WORK VEHICLE

RELATED APPLICATIONS

This application relates to U.S. application Ser. No. 16/058,055, titled "SYSTEM AND METHOD OF SOIL MANAGEMENT FOR AN IMPLEMENT," filed Aug. 8, 2018, and U.S. application Ser. No. 16/029,845, titled "WORK MACHINE GRADING CONTROL SYSTEM," filed Jul. 9, 2018, both of which are hereby incorporated by reference in their entirety.

FIELD OF THE DISCLOSURE

The present disclosure relates generally to systems for improving work vehicle productivity, and, more particularly, to a system and method for maximizing the productivity of a work vehicle in real-time based on a material flow rate.

BACKGROUND OF THE DISCLOSURE

Work vehicles, such as a motor grader, can be used in construction and maintenance for grading terrain to a flat surface at various angles, slopes, and elevations. When paving a road for instance, a motor grader can be used to prepare a base foundation to create a wide flat surface to support a layer of asphalt. A motor grader can include two or more axles, with an engine and cab disposed above the axles at the rear end of the vehicle and another axle disposed at the front end of the vehicle. An implement, such as a blade, is attached to the vehicle between the front axle and rear axle.

Each surface being graded includes surface irregularities and surface materials of different types. While current grade control systems are used to adjust the implement based on inputs received from the machine control system, such systems do not account for the type of surface material being graded. Because characteristics of surface materials vary widely, grading operations can be affected in different ways based on the types of surface materials. For example, some grading operations require increased machine efforts which lead to poor performance. Therefore, a need exists for an improved system that maximizes productivity and increases vehicle performance and efficiency.

SUMMARY OF THE DISCLOSURE

According to an aspect of the present disclosure, a system for maximizing the productivity of a work vehicle is disclosed. The system includes a first sensor system, a second sensor system, and an actuator system each communicatively coupled to an electronic data processor. The first sensor system is configured to generate a first signal output indicative of a height of a material arranged forward of the work vehicle relative to a reference point on the work vehicle. The second sensor system is configured to generate a second signal output indicative of a blade position and blade height of at least one material transport blade coupled to the work vehicle. The actuator system is coupled to the work vehicle and the at least one material transport blade, and configured to adjust the blade position and the blade height of the at least one material transport blade. The electronic data processor communicatively is configured to determine a material flow rate of the material based on the first signal output and the second signal output, and wherein the electronic data processor is configured to provide a command signal to the actuator system to dynamically adjust a plurality of operating parameters associated with the material transport blade within a predetermined threshold range to maximize the material flow rate output.

According to another aspect of the present disclosure, a work vehicle is disclosed. The work vehicle can comprise a vehicle frame supported by a plurality of ground engaging wheels. At least one material transport blade coupled to the vehicle frame. A first sensor system that is configured to generate a first signal output indicative of a height of a material arranged forward of the work vehicle relative to a reference point on the work vehicle. A second sensor system that is configured to generate a second signal output indicative of a blade position and blade height of at least one material transport blade coupled to the work vehicle. An actuator system coupled to the work vehicle and the at least one material transport blade that is configured to adjust the blade position and the blade height of the at least one material transport blade. An electronic data processor is communicatively coupled to each of the first sensor system, the second sensor system, and the actuator system. The electronic data processor is configured to determine a material flow rate of the material based on the first signal output and the second signal output, and wherein the electronic data processor is configured to provide a command signal to the actuator system to dynamically adjust a plurality of operating parameters associated with the material transport blade within a predetermined threshold range to maximize the material flow rate output.

According to other aspects of the present disclosure, a method is disclosed. The method comprises capturing at least one image of a quantity of material arranged forward of a work vehicle; determining a height of the quantity of material relative to a frame of the work vehicle; determining a blade position and a blade height of at least one material transport blade; determining a material flow rate based on the height of the quantity of material and the blade position; and dynamically adjusting a plurality of operating parameters associated with the material transport blade within a predetermined threshold range to maximize the material flow rate output.

Other features and aspects will become apparent by consideration of the detailed description and accompanying drawings.

BRIEF DESCRIPTION OF THE DRAWINGS

The detailed description of the drawings refers to the accompanying figures in which.

Like reference numerals are used to indicate like elements throughout the several figures.

DETAILED DESCRIPTION OF THE DRAWINGS

Figure 1:
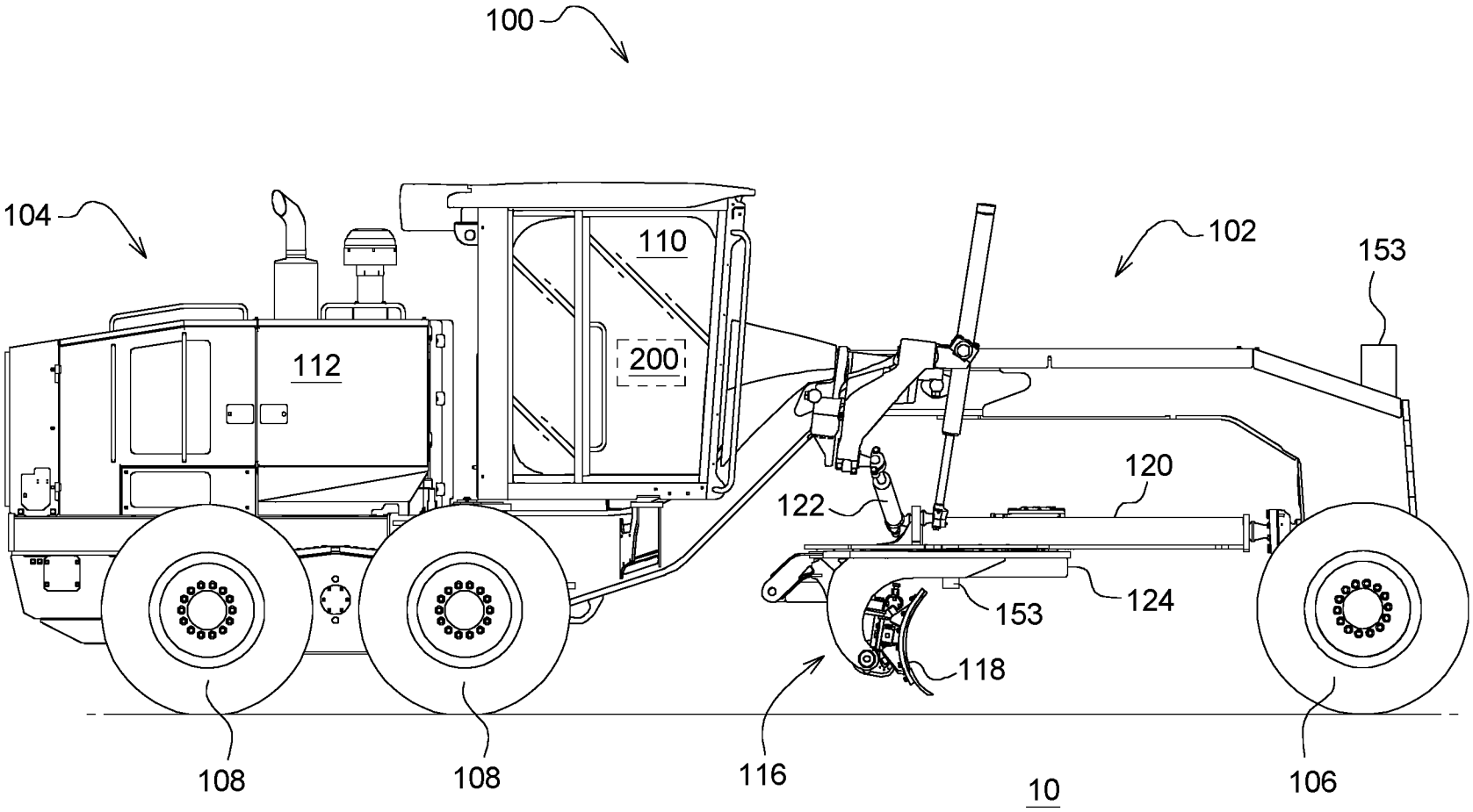
FIG. 1 is a side view illustration of a work vehicle including a system for maximizing productivity of the work vehicle according to an embodiment.
Figure 2:
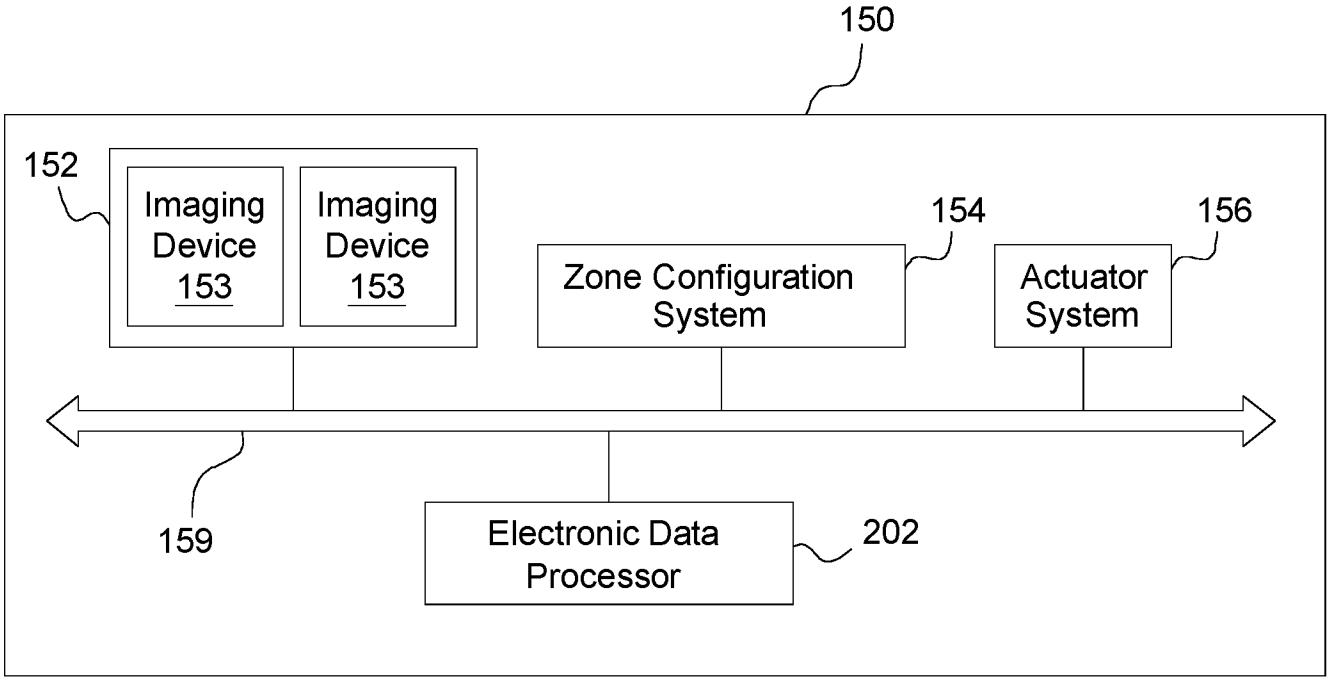
FIG. 2 is a block diagram of a system for maximizing productivity of the work vehicle of FIG. 1 according to an embodiment.

Referring to FIGS. 1 and 2, a work vehicle 100 comprising a system 150 is shown in an exemplary embodiment. As will be discussed herein, the system 150 maximizes productivity of the work vehicle 100 in real-time based on a measured material flow rate. Although the work vehicle 100 is shown as including a construction vehicle (e.g., a motor grader) in FIG. 1, it should be noted that, in other embodiments, the work vehicle 100 can vary according to application and specification requirements. For example, in other embodiments, the work vehicle 100 can include forestry, agricultural, turf, or on-road vehicles, with embodiments discussed herein being merely for exemplary purposes to aid in an understanding of the present disclosure.

The work vehicle 100 can comprise a frame assembly including a first frame 102 (e.g., a front frame) and a second frame 104 (e.g., a rear frame) structurally supported by wheels 106, 108. An operator cab 110, which includes a variety of control mechanisms accessible by a vehicle operator, can be mounted to the first frame 102. An engine 112 can be mounted to the second frame 104 and arranged to drive the wheels 108 at various speeds via coupling through a drive transmission (not shown). As shown in FIG. 1, a blade assembly 116 can be coupled to the first frame 102 and can be arranged to perform a variety of ground engaging tasks such as pushing, leveling, or spreading of soil at worksite 10. The blade assembly 116 can comprise at least one material transport blade 118 having generally concave shapes coupled to a ring-shaped gear 124.

In some embodiments, the system 150 can comprise a first sensor system 152, a second sensor system 154, and an actuator system 156 each communicatively coupled to an electronic data processor 202 to maximize productivity in real-time based on a determined material flow rate. In some embodiments, the first sensor system 152 can comprise one or more imaging devices 153 such as radar sensors, cameras, thermal imaging sensors, infrared imaging devices, lidar sensors, ultrasonic sensors, or other suitable devices capable of capturing real-time images or video. The imaging devices 153 can be mounted in a variety of locations around the work vehicle 100 such as on a front, rear, side, and/or top panel of the work vehicle 100 to provide for a wide and expansive field of view. For example, the imaging devices 153 can be arranged to capture images of a ground area (e.g., ground material piles) being approached by the work vehicle 100. In other embodiments, the imaging devices 153 can work collectively with other sensor devices arranged on the work vehicle 100 or auxiliary work vehicles arranged in the same or a nearby field.

As shown in FIG. 2, the second sensor system 154 can be communicatively coupled to the first sensor system 152 and the actuator system 156 via a communication bus 159. The second sensor system 154 can comprise one or more position sensors that provide position feedback for the material transport blade 118. For example, in some embodiments, the position sensors can comprise linear or multi-axis sensors such as, but not limited to, capacitive sensors, proximity sensors, ultrasonic sensors, Hall effect sensors, or other suitable sensing devices capable of detecting a positional movement of the blade. In other embodiments, the second sensor system 154 can further comprise one or more inertial sensors that observe a force of gravity and an acceleration associated with the material transport blade 118. Further, in yet other embodiments, the second sensor system 154 can utilize location and position data received from a location-determining receiver 218 or a grade control system 226 to control positional and/or angular movement of the material transport blade 118.

The actuator system 156 can comprise one or more control circuits having a plurality of hydraulic actuators 122 or other control devices arranged therein to control movement and positioning of the material transport blade 118. As shown in FIG. 1, in some embodiments, the hydraulic actuators 122 can be coupled to a drawbar 120 to facilitate the raising and lowering of the material transport blade 118. Additionally, the material transport blade 118 can extend parallel to the ring-shaped gear 124 and can be arranged such that rotation of the ring-shaped gear 124 facilitates movement of the material transport blade 118 relative to the first frame 102.

Figure 3A:
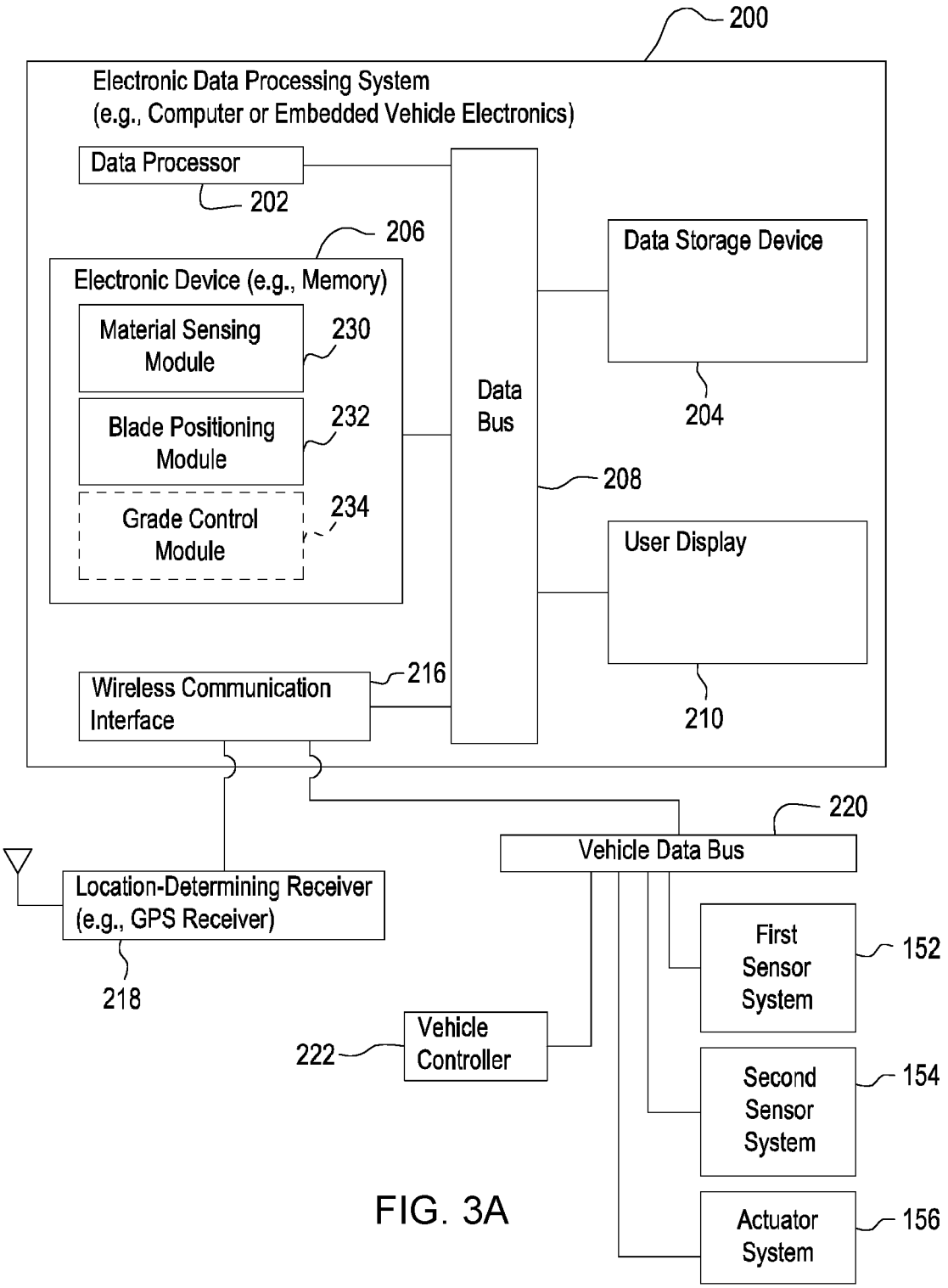
FIG. 3A is a block diagram of a vehicle electronics unit arranged in the work vehicle of FIG. 1 according to an embodiment.
Figure 3B:
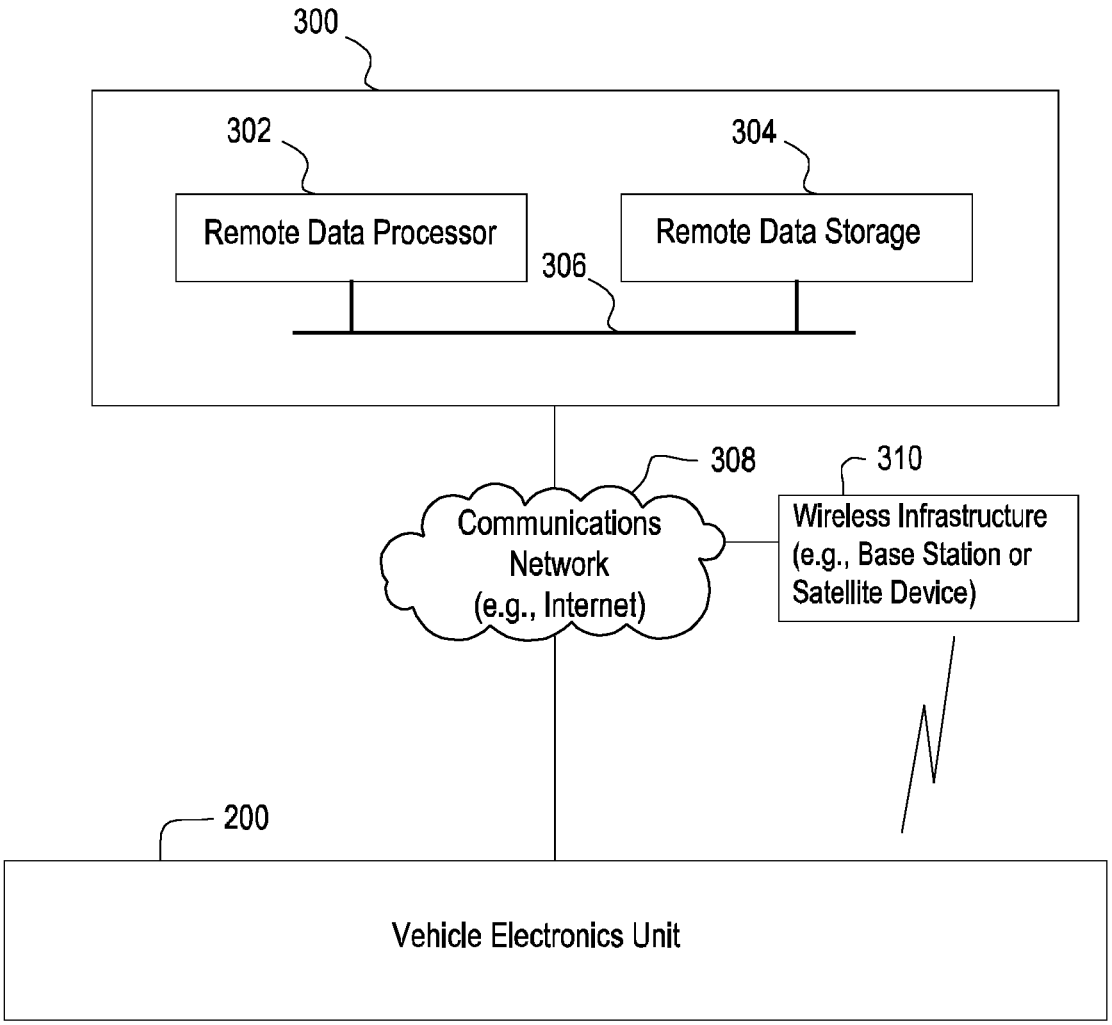
FIG. 3B is a block diagram of a remote processing system according to an embodiment.

The electronic data processor 202 can be arranged locally as part of a vehicle electronics unit 200 of the work vehicle 100 or remotely at a remote processing system 300 (FIG. 3B). In various embodiments, the electronic data processor 202 can comprise a microprocessor, a microcontroller, a central processing unit, a programmable logic array, a programmable logic controller, other suitable programmable circuitry that is adapted to perform data processing and/or system control operations. For example, as will be discussed in further detail with reference to FIG. 4, the electronic data processor 202 can be configured to determine an optimal productivity value for a work vehicle based on a determined material flow rate.

As will be appreciated by those skilled in the art, FIGS. 1 and 2 are provided for illustrative and exemplary purposes only and are in no way intended to limit the present disclosure or its applications. In other embodiments, the arrangement and/or structural configuration of the system 150 can vary. For example, in some embodiments, the system 150 can comprise additional sensing devices. Further, in other embodiments, the system 150 can comprise a network of distributed systems arranged on a plurality of vehicles located at a single worksite or several remote worksites.

Referring now to FIGS. 3A and 3B, a block diagram of a vehicle electronics unit 200 and a remote processing system 300 are shown according to an embodiment. The vehicle electronics unit 200 can comprise the electronic data processor 202, a data storage device 204, an electronic device 206, a wireless communications device 216, the display 210, the location-determining receiver 218, and a vehicle data bus 220 each communicatively interfaced with a data bus 208. As depicted, the various devices (i.e., data storage device 204, wireless communications device 216, display 210, and vehicle data bus 220) can communicate information, e.g., sensor signals, over the data bus 208 to the electronic data processor 202.

The electronic data processor 202 manages the data transfer between the various vehicle systems and components, which, in some embodiments, can include data transfer to and from the remote processing system 300. For example, the electronic data processor 202 collects and processes data (e.g., ground material profile data or material flow rate) from the data bus 208 for transmission either in a forward or rearward direction to the remote processing system 300. As shown in FIG. 3B, the remote processing system 300 can comprise a remote data processor 302 and a remote data storage device 304 coupled to a remote data bus 306. In various embodiments, the remote processing system 300 can be implemented by a general-purpose computer or a server that is programmed with software modules stored in the remote data storage device 304.

In other embodiments, the electronic data processor 202 can receive or transfer information to and from other processors or computing devices. For example, ground material/profile data which is processed by the electronic data processor 202 can be received or transferred from other computers and or data collected from the imaging devices 153 arranged on the work vehicles may be transferred to another a processor on another work vehicle. In still other embodiments, the information/data may be transmitted via a network to a central processing computer for further processing. For example, a first work vehicle may store a computerized model of worksite 10 (i.e., a map of the worksite) and the work to be performed at a different work site by a second work vehicle.

The data storage device 204 stores information and data (e.g., geocoordinates or ground images) for access by the electronic data processor 202 or the vehicle data bus 220. The data storage device 204 can comprise electronic memory, nonvolatile random-access memory, an optical storage device, a magnetic storage device, or another device for storing and accessing electronic data on any recordable, rewritable, or readable electronic, optical, or magnetic storage medium.

The vehicle data bus 220 supports communications between one or more of the following components: a vehicle controller 222, the first sensor system 152, the second sensor system 154, and the electronic data processor 202. In other alternative embodiments, the system 150 can optionally comprise a grade control system 226, and/or one or more monitoring sensors 158 communicatively coupled to the vehicle data bus 220. In some embodiments, the monitoring sensors 158 can be arranged on or proximate the material transport blade 118 and can be configured to measure a quantity of ground material collected by the blade 118 as the ground material is transported and/or leveled. The vehicle controller 222 can comprise a device for steering or navigating the work vehicle 100 according to instructions received by the grade control system 226 or other instructions provided by a vehicle operator based on feedback received from the first or second sensor systems 152, 154.

The location-determining receiver 218 may comprise a receiver that uses satellite signals, terrestrial signals, or both to determine the location or position of an object or the vehicle. In one embodiment, the location-determining receiver 218 comprises a Global Positioning System (GPS) receiver with a differential correction receiver for providing precise measurements of the geographic coordinates or position of the vehicle. The differential correction receiver may receive satellite or terrestrial signal transmissions of correction information from one or more reference stations with generally known geographic coordinates to facilitate improved accuracy in the determination of a location for the GPS receiver, for example.

In other alternative embodiments, position and location data can be processed by the grade control system 226. For example, one or more position signals can be received from the location-determining receiver 218 arranged, e.g., on the operator cab 110 of the work vehicle 100. The grade control system 226 can determine a location of the material transport blade 118 and generate command signals communicated to the vehicle controller 222 to change a position of the material transport blade 118 based on signals received from/by the location-determining receiver 218.

The electronic device 206 can comprise electronic memory, nonvolatile random-access memory, flip-flops, a computer-writable or computer-readable storage medium, or another electronic device for storing, retrieving, reading or writing data. The electronic device 206 can include one or more software modules that records and stores data collected by the first sensor system 152, the second sensor system 154, or other network devices coupled to or capable of communicating with the vehicle data bus 220. In some embodiments, the one or more software modules, for example, can include a material sensing module 230, a blade positioning module 232, or optionally a grade control module 234, each comprising executable software instructions or data structures that is processed by the electronic data processor 202.

The term module as used herein may include a hardware and/or software system that operates to perform one or more functions. Each module can be realized in a variety of suitable configurations, and should not be limited to any particular implementation exemplified herein, unless such limitations are expressly called out. Moreover, in the various embodiments described herein, each module corresponds to a defined functionality; however, in other embodiments, each functionality may be distributed to more than one module. Likewise, in other embodiments, multiple defined functionalities may be implemented by a single module that performs those multiple functions, possibly alongside other functions, or distributed differently among a set of modules than specifically illustrated in the examples herein.

In some embodiments, the material sensing module 230 can record and store real-time imaging data collected by the first sensor system 152. For example, the material sensing module 230 can generate two-dimensional or three-dimensional material profiles of the ground material based on the images captured by the one or more imaging devices 153. In various embodiments, the material profiles can vary based on the type of ground material, which can include materials such as soil, rock, pebble, stone, minerals, organic matter, clay and vegetation as examples. Additionally, in some embodiments, the material sensing module 230 can associate color data, location data, environmental data, and/or ground characteristics with the material profile.

The blade positioning module 232 can determine an optimal blade position or angular rotation based on the generated material profile. In some embodiments, the blade positioning module 232 can output command signals received by the actuator system 156 to adjust a position or angle of the material transport blade 118 based on inputs received from the material sensing module 230 and one or more position sensors. For example, the position or angle of the blade can be adjusted by the actuator system 156 to optimize displacement of the material as it is collected or moved by the blade. In other embodiments, an orientation of the material transport blade 118 can be controlled via the grade control module 234. For example, the grade control module 234 can utilize GPS and stored terrain data output by the grade control system 226 to adjust a position and orientation of the material transport blade 118.

Figure 4:
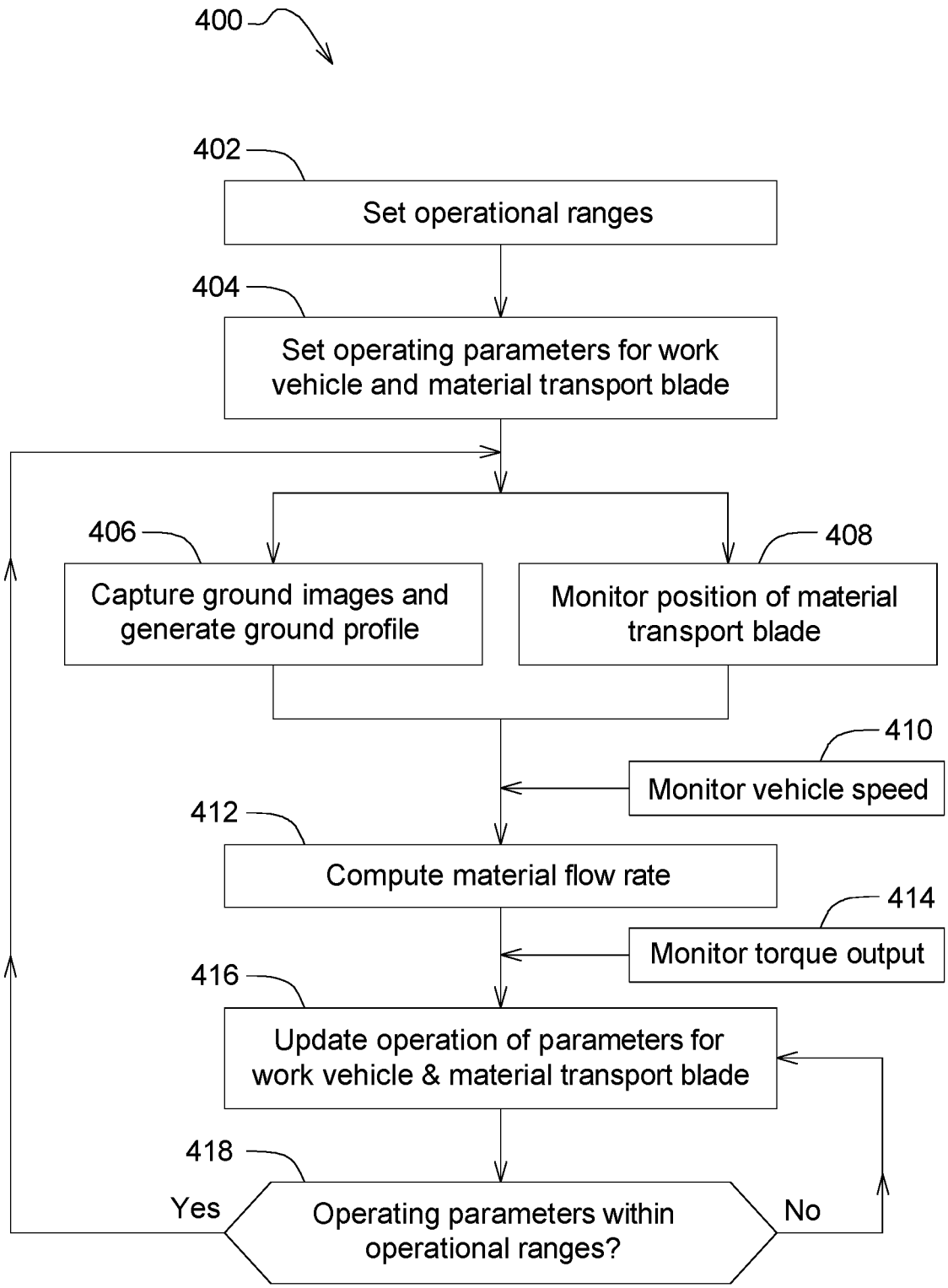
FIG. 4 is a flow diagram of a method for maximizing productivity of the work vehicle of FIG. 1.

Referring now to FIG. 4, a flow diagram of a method 400 for maximizing productivity of work vehicle 100 is shown. At 402, upon start-up of the work vehicle 100, a vehicle operator may input predefined operational ranges to establish upper and lower threshold values for one or more operating parameters via the user interface of the display 210. The one or more operating parameters can include, without limitation, blade position, blade depth, blade pitch, blade side shift, circle angle, articulation angle, gear position, engine speed, vehicle speed, drivetrain configuration (e.g., 4WD or 6WD), circle side shift, wheel lean, combinations thereof, or other suitable parameters. As the work vehicle 100 travels across the worksite 10, the operating parameters of the work vehicle 100 and material transport blade 118 can be adjusted automatically via the electronic data processor 202 or manually via the display 210 based on a desired grade profile or operational output at 404.

Next at 406, the first sensor system 152 can receive information about the environment of worksite 10 based on the images captured by the imaging devices 153. For example, a ground profile of material arranged forward of the work vehicle 100 can be generated by the material sensing module 230 utilizing data inputs from the imaging devices 153. The material sensing module 230 also determines a height of the material relative to a reference point on the work vehicle 100 based on the ground profiles. In other embodiments, the material sensing module 230 can determine a ground profile based on imaging received from one or monitoring sensors 158 arranged on the material transport blade 118 as discussed with reference to FIGS. 3A and 3B.

As the environmental and ground profile data is captured at 406, the second sensor system 154 continuously monitors a position of the material transport blade 118 and generates an output signal indicative of a current blade position and/or blade height of the material transport blade 118 at 408. Additionally, collectively with the position data, a vehicle speed of the work vehicle 100 is monitored at 410.

At 412, the electronic data processor 202 computes a volumetric flow rate (i.e., material flow rate) of material moved by the material transport blade 118 based on the determined height of the ground material, the current blade position, and the vehicle speed. At 414, the electronic data processor 202 can receive speed and torque data from one or more speed and torque sensors (not shown). For example, in some embodiments, the electronic data processor 202 can receive speed and torque feedback from various vehicle systems and components such as electric motors, propulsion systems, drivetrains, or other suitable systems to provide real-time torque and speed outputs. This information can be used to inform the vehicle operator of the amount of torque being required by the work vehicle 100 to move the material, as well as the required vehicle speed.

Next at 416, the electronic data processor 202 provides a command signal to the actuator system 156 to dynamically modify one or more of the operating parameters to adjust a position of the material transport blade 118. For example, based on the determined material flow rate, the electronic data processor 202 maintains the operating parameters within the predetermined operational ranges to maximize the amount of material moved by the material transport blade 118 without exceeding the operational limits of the work vehicle 100.

Once the operating parameters are adjusted, a decision is made at 418 to determine if the operating parameters exceed the upper threshold value or fall below the lower threshold value. If the values are outside the operational ranges (i.e., above or below the threshold values), the electronic data processor 202 readjusts the operating parameters at 416 based on the material flow rate. For example, to maximize productivity of the work vehicle 100, the electronic data processor 202 would continuously monitor the material flow rate and engine effort, and adjust the operating parameters to account for any changes in material flow rate while not exceeding a blade pull limit and/or a tractive limit of ground conditions of the work vehicle 100.

Additionally, in some embodiments, a warning alert can be generated and displayed on the display 210 if the operating parameters fall outside the desired threshold range or when the work vehicle 100 is proximate or within a predetermined range of the warning zones.

Without in any way limiting the scope, interpretation, or application of the claims appearing below, a technical effect of one or more of the example embodiments disclosed herein is a system and method for maximizing productivity of a work vehicle. The system is particularly advantageous in that it allows for productivity of the work vehicle to be maximized in real-time based on a material flow rate.

While the above describes example embodiments of the present disclosure, these descriptions should not be viewed in a limiting sense. Rather, other variations and modifications may be made without departing from the scope and spirit of the present disclosure as defined in the appended claims.

What is claimed is:

1. A system for maximizing productivity of a work vehicle, the system comprising:

a first sensor system, wherein the first sensor system is configured to generate a first signal output indicative of a height of a material arranged forward of the work vehicle relative to a reference point on the work vehicle;

a second sensor system, wherein the second sensor system is configured to generate a second signal output indicative of a blade position and blade height of at least one material transport blade coupled to the work vehicle;

an actuator system coupled to the work vehicle and the at least one material transport blade, wherein the actuator system configured to adjust the blade position and the blade height of the at least one material transport blade; and an electronic data processor communicatively coupled to each of the first sensor system, the second sensor system, and the actuator system, wherein the electronic data processor is configured to determine a material flow rate of the material based on the first signal output and the second signal output, and wherein the electronic data processor is configured to provide a command signal to the actuator system to dynamically adjust a plurality of operating parameters associated with the material transport blade within a predetermined threshold range to maximize the material flow rate output.

2. The system of claim 1, wherein the material flow rate comprises a volume of material that is moved forward of the work vehicle over a defined distance per unit time.

3. The system of claim 1, wherein the blade position comprises a side-shift position of the material transport blade.

4. The system of claim 1, wherein the plurality of operating parameters comprises one or more of the following: blade position, blade depth, blade pitch, blade side shift, circle angle, articulation angle, gear position, engine speed, vehicle speed, drivetrain configuration (e.g., 4WD or 6WD), circle side shift, wheel lean, combinations thereof.

5. The system of claim 1, wherein the first sensor system comprises one or more of the following: 2-D cameras, 3-D cameras, stereo cameras, laser scanning devices, ultrasonic sensors, light detection and ranging (LIDAR) scanners, radar devices, or combinations thereof.

6. The system of claim 1, wherein the second sensor system comprises a plurality of position sensors arranged on or proximate the material transport blade.

7. The system of claim 1, wherein the electronic data processor is further configured to determine a torque output and a speed output to compute power parameters and a vehicle speed of the work vehicle, and wherein the material flow rate is determined at least in part based on the power parameters and the vehicle speed.

8. The system of claim 1, wherein the electronic data processor is further configured to maximize the material flow rate by adjusting the operating parameters within the predetermined threshold range to not exceed a maximum blade pull value or a tractive limit of the work vehicle.

9. The system of claim 1, further comprising a monitoring sensor arranged on or proximate the material transport blade, wherein the monitoring sensor is configured to generate an output signal indicative of an amount of material arranged on a surface of the material transport blade.

10. The system of claim 9, wherein the monitoring sensor is communicatively coupled to the electronic data processor, and wherein the electronic data processor is further configured to determine the material flow rate based on the amount of material arranged on the surface of the material transport blade and the second signal output.

11. A work vehicle, the work vehicle comprising:

a vehicle frame supported by a plurality of ground engaging wheels;

at least one material transport blade coupled to the vehicle frame;

a first sensor system, wherein the first sensor system is configured to generate a first signal output indicative of a height of a material arranged forward of the work vehicle relative to a reference point on the work vehicle;

a second sensor system, wherein the second sensor system is configured to generate a second signal output indicative of a blade position and blade height of at least one material transport blade coupled to the work vehicle;

an actuator system coupled to the work vehicle and the at least one material transport blade, wherein the actuator system configured to adjust the blade position and the blade height of the at least one material transport blade; and an electronic data processor communicatively coupled to each of the first sensor system, the second sensor system, and the actuator system, wherein the electronic data processor is configured to determine a material flow rate of the material based on the first signal output and the second signal output, and wherein the electronic data processor is configured to provide a command signal to the actuator system to dynamically adjust a plurality of operating parameters associated with the material transport blade within a predetermined threshold range to maximize the material flow rate output.

12. The work vehicle of claim 11, wherein the plurality of operating parameters comprises one or more of the following: blade position, blade depth, blade pitch, blade side shift, circle angle, articulation angle, gear position, engine speed, vehicle speed, drivetrain configuration (e.g., 4WD or 6WD), circle side shift, wheel lean, combinations thereof.

13. The work vehicle of claim 11, wherein the electronic data processor is further configured to determine a torque output and a speed output to compute power parameters and a vehicle speed of the work vehicle, and wherein the material flow rate is determined at least in part based on the power parameters and the vehicle speed.

14. The work vehicle of claim 11, wherein the electronic data processor is further configured to maximize the material flow rate by adjusting the operating parameters within the predetermined threshold range to not exceed a maximum blade pull value or a tractive limit of the work vehicle.

15. The work vehicle of claim 11, further comprising a monitoring sensor arranged on or proximate the material transport blade, wherein the monitoring sensor is configured to generate an output signal indicative of an amount of material arranged on a surface of the material transport blade.

16. The work vehicle of claim 15, wherein the monitoring sensor is communicatively coupled to the electronic data processor, and wherein the electronic data processor is further configured to determine the material flow rate based on the amount of material arranged on the surface of the material transport blade and the second signal output.

17. A method, the method comprising:

capturing at least one image of a quantity of material arranged forward of a work vehicle;

determining a height of the quantity of material relative to a frame of the work vehicle;

determining a blade position and a blade height of at least one material transport blade;

determining a material flow rate based on the height of the quantity of material and the blade position; and dynamically adjusting a plurality of operating parameters associated with the material transport blade within a predetermined threshold range to maximize the material flow rate output.

18. The method of claim 17, wherein dynamically adjusting the plurality of operating parameters further comprises adjusting the operating parameters within the predetermined threshold range to not exceed a maximum blade pull value or a tractive limit of the work vehicle.

19. The method of claim 17, further comprising determining a torque output and a speed output to compute power parameters and a vehicle speed of the work vehicle, and wherein the material flow rate is determined at least in part based on the power parameters and the vehicle speed.

20. The method of claim 17, further comprising generating, by a monitoring sensor, an output signal indicative of an amount of material arranged on a surface of the material transport blade, and wherein the material flow rate is determined based on the amount of material arranged on the surface of the material transport blade, the blade position, and the blade height.

* * * * *